US008226280B2

(12) United States Patent
Daily et al.

(10) Patent No.: US 8,226,280 B2
(45) Date of Patent: Jul. 24, 2012

(54) LED SOCKET ASSEMBLY

(75) Inventors: Christopher George Daily, Harrisburg, PA (US); Matthew Edward Mostoller, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 238 days.

(21) Appl. No.: 12/771,772

(22) Filed: Apr. 30, 2010

(65) Prior Publication Data

US 2011/0267831 A1 Nov. 3, 2011

Related U.S. Application Data

(60) Provisional application No. 61/328,975, filed on Apr. 28, 2010.

(51) Int. Cl.
*F21V 21/00* (2006.01)

(52) U.S. Cl. ..... 362/396; 362/249.01; 362/249.02

(58) Field of Classification Search ..... 362/396, 362/249.01, 249.02
See application file for complete search history.

(56) References Cited

U.S. PATENT DOCUMENTS

| | | | | |
|---|---|---|---|---|
| 6,129,443 | A * | 10/2000 | Murata et al. | 362/267 |
| 7,677,914 | B2 * | 3/2010 | Nall et al. | 439/420 |
| 2006/0262533 | A1 * | 11/2006 | Lin et al. | 362/249 |
| 2007/0190845 | A1 * | 8/2007 | Mrakovich et al. | 439/404 |
| 2008/0030981 | A1 * | 2/2008 | Mrakovich et al. | 362/219 |
| 2009/0244925 | A1 | 10/2009 | Snagel et al. | |

FOREIGN PATENT DOCUMENTS

| | | |
|---|---|---|
| DE | 203 17 174 | 4/2004 |
| DE | 20 208 017257 | 4/2009 |
| WO | WO 2007/047398 | 4/2007 |

OTHER PUBLICATIONS

International Search Report, International Application No. PCT/US2011/000734, International Filing Date Apr. 27, 2011.

* cited by examiner

*Primary Examiner* — Evan Dzierzynski

(57) ABSTRACT

A socket assembly is provided for mounting on a base of a lighting fixture. The socket assembly includes a socket housing having a base side, a clip side, and a side wall extending from the base side to the clip side. The base side of the socket housing is configured to be mounted on the base of the lighting fixture. The socket housing includes a receptacle extending therein. A light emitting diode (LED) is held within the receptacle of the socket housing. The socket assembly further includes a mounting clip having a strap and an arm that extends from the strap. The strap extends over and is engaged with the clip side of the socket housing. The arm extends outwardly from the strap along the side wall of the socket housing and is configured to engage the base of the lighting fixture to hold the socket housing on the base.

19 Claims, 8 Drawing Sheets

LED SOCKET ASSEMBLY

CROSS REFERENCE TO RELATED APPLICATIONS

This application is a nonprovisional patent application of, and claims priority to and the benefit of the filing date of, U.S. Provisional Patent Application No. 61/328,975, filed on Apr. 28, 2010 and entitled "Led Socket Assembly", which is hereby incorporated by reference in its entirety.

BACKGROUND OF THE INVENTION

The subject matter described and/or illustrated herein relates generally to lighting fixtures, and more particularly, to light emitting diode (LED) socket assemblies for lighting fixtures.

Solid-state lighting systems use solid state light sources, such as light emitting diodes (LEDs), and are being used to replace other lighting systems that use other types of light sources, such as incandescent or fluorescent lamps. The solid-state light sources offer advantages over the lamps, such as rapid turn-on, rapid cycling (on-off-on) times, long useful life span, low power consumption, narrow emitted light bandwidths that eliminate the need for color filters to provide desired colors, and so on.

LED lighting systems sometimes include LEDs soldered down to a printed circuit board (PCB). The PCB then is mounted on the base (e.g., a heat sink) of a lighting fixture. In known LED lighting systems, mechanical hardware and/or adhesives are used to mount the PCB or LED to the lighting fixture base. Specifically, the PCB is mounted on the base of the lighting fixture using screws, rivets, glue, double-sided tape, epoxy, or solder. Wires are soldered to the PCB to provide electrical power to the LED. But, such known methods for mounting on the lighting fixture base and providing electrical power to the LED are not without disadvantages. For example, mounting the PCB on the lighting fixture base using mechanical hardware and/or adhesives may be time consuming, which may increase the cost of assembling the LED lighting system. Soldering the electrical power wires to the PCB may also be a time consuming, and thus costly, process. Moreover, the solder connection between electrical power wires and the PCB may be less reliable than is desired. Problems may also arise when the LED and/or the PCB needs to be replaced. For example, it may be tedious and may require a skilled person to perform the removal and replacement of the LEDs and/or PCBs.

BRIEF DESCRIPTION OF THE INVENTION

In one embodiment, a socket assembly is provided for mounting on a base of a lighting fixture. The socket assembly includes a socket housing having a base side, a clip side, and a side wall extending from the base side to the clip side. The base side of the socket housing is configured to be mounted on the base of the lighting fixture. The socket housing includes a receptacle extending therein. A light emitting diode (LED) is held within the receptacle of the socket housing. The socket assembly further includes a mounting clip having a strap and an arm that extends from the strap. The strap extends over and is engaged with the clip side of the socket housing. The arm extends outwardly from the strap along the side wall of the socket housing and is configured to engage the base of the lighting fixture to hold the socket housing on the base.

In another embodiment, a lighting fixture includes a base and a socket assembly mounted on the base. The socket assembly includes a socket housing having a base side, a clip side, and a side wall extending from the base side to the clip side. The base side of the socket housing is mounted on the base. The socket housing includes a receptacle extending therein. A light emitting diode (LED) is held within the receptacle of the socket housing. The socket assembly further includes a mounting clip including a strap and an arm that extends from the strap. The strap extends over and is engaged with the clip side of the socket housing. The arm extends outwardly from the strap along the side wall of the socket housing and is engaged with the base to hold the socket housing on the base between the base and the strap.

In another embodiment, a socket assembly is provided for mounting on a base of a lighting fixture. The socket assembly includes a socket having a housing and a mounting feature. The housing has a base side that is configured to be mounted on the base of the lighting fixture. A receptacle extends into the housing. The mounting feature includes a resiliently deflectable arm that is configured to engage the base of the lighting fixture in a snap-fit connection to releasably mount the socket to the base. A light emitting diode (LED) is held within the receptacle of the housing of the socket.

DETAILED DESCRIPTION OF THE INVENTION

Figure 1:
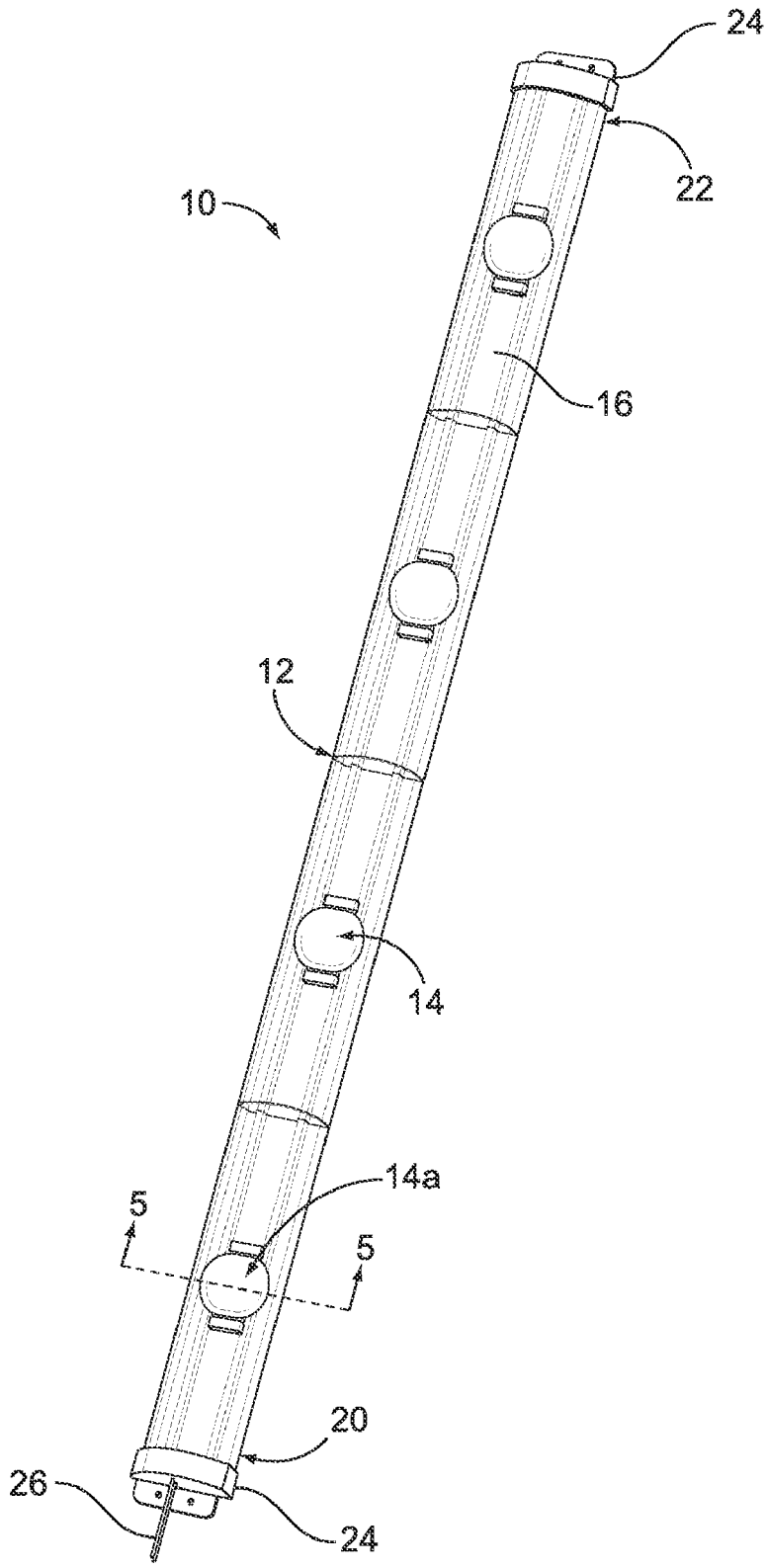
FIG. 1 is a perspective view of an exemplary embodiment of a lighting fixture.

FIG. 1 is a perspective view of an exemplary embodiment of a lighting fixture 10. The lighting fixture 10 includes a base 12, a plurality of socket assemblies 14 mounted on the base 12, and an optional lens 16 mounted on the base 12. Each socket assembly 14 includes one or more light emitting diodes (LEDs) 18 (FIGS. 2 and 5) that emit light. As will be described below, the socket assemblies 14 are mounted on the base 12 using a mounting feature (e.g., the mounting clip 38 described below) that engages the base 12 in a snap-fit connection to releasably mount the socket assemblies 14 on the base 12.

The base 12 extends a length from an end 20 to an opposite end 22. Optionally, the base 12 is a heat sink that is configured to dissipate heat from the LEDs 18. The lens 16 extends along the base 12 from the end 20 to the end 22 such that the lens 16 extends over each of the socket assemblies 14. In the exemplary embodiment, the lens 16 is sufficiently translucent to enable the base 12 and the socket assemblies 14 to be seen through the lens 16 in FIG. 1. End caps 24 or other suitable structures are optionally provided at the ends 20 and 22 of the base 12 to seal the interior space between the lens 16 and the base 12 of the lighting fixture 10.

The lighting fixture 10 includes a main power cable 26 that provides electrical power to the lighting fixture 10 from an electrical power source (not shown). In the exemplary embodiment, the main power cable 26 is fed to the base 12 at the end 20 and is electrically connected to the socket assembly 14*a* that is closest to the end 20. Moving along the length of the base 12 toward the end 22, each successive socket assembly 14 is electrically connected to the preceding adjacent socket assembly 14 via a separate corresponding cable (not shown) that extends between and electrically connects the adjacent socket assemblies 14. Alternatively, each socket assembly 14 receives electrical power from the main power cable 26 via a corresponding electrical cable, electrical connector, and/or the like (not shown) that branches off from the main power cable 26.

The exemplary embodiment of the lighting fixture 10 is what is commonly referred to as a "light bar" because the base 12 is elongated and the LEDs 18 are arranged successively along the length of the base 12. The lighting fixture 10 may be used for residential, commercial, and/or industrial lighting. The lighting fixture 10 may be used for general purpose lighting, or alternatively, may have a customized application, end use, and/or the like. One exemplary use for the lighting fixture 10 is for lighting food and/or beverage display cases, for example in grocery stores, supermarkets, convenience stores, and/or the like.

Figure 2:
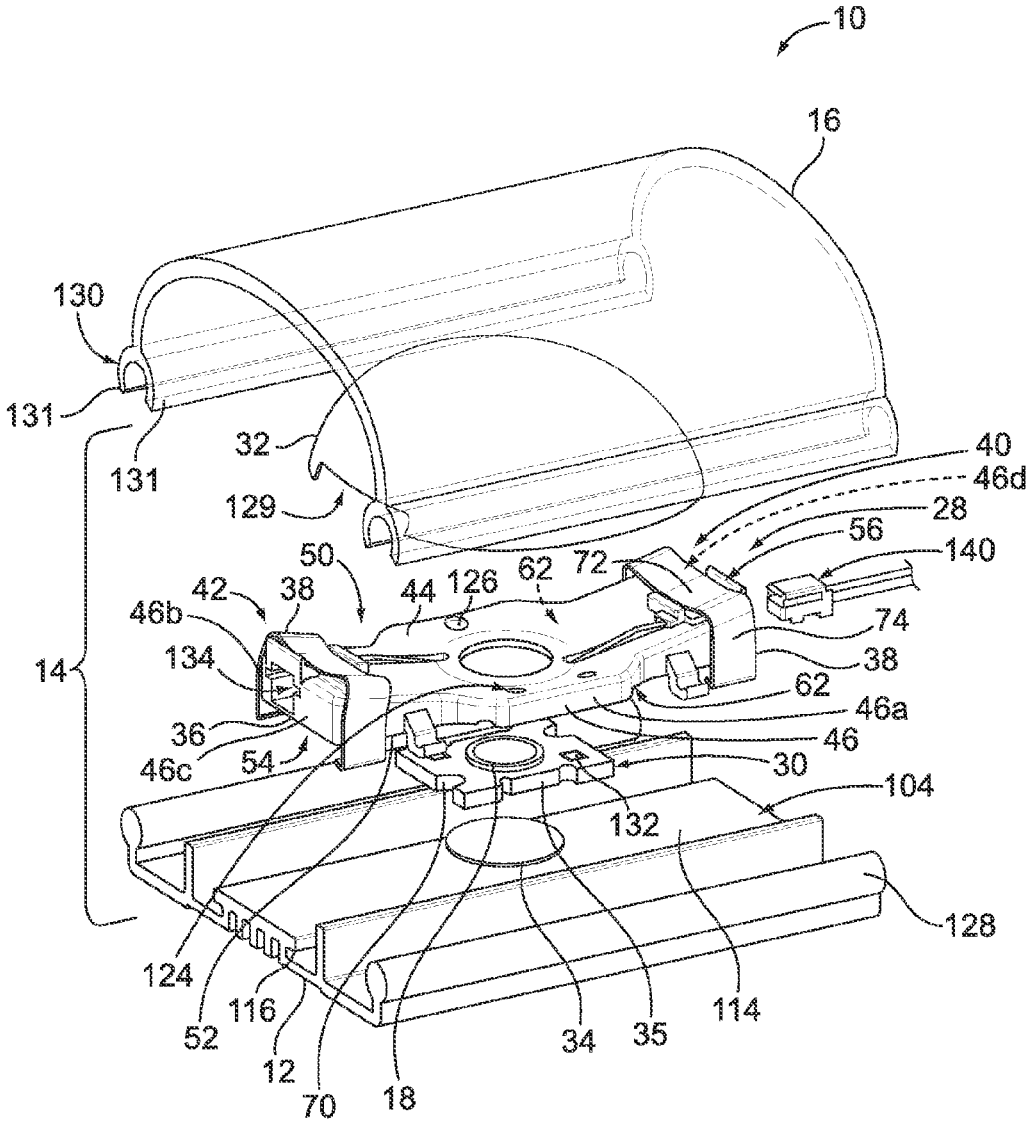
FIG. 2 is an exploded perspective view of a portion of the lighting fixture shown in FIG. 1 illustrating an exemplary embodiment of a socket assembly of the lighting fixture.

FIG. 2 is an exploded perspective view of a portion of the lighting fixture 10 illustrating an exemplary embodiment of one of the socket assemblies 14. In addition to the socket assembly 14, portions of the base 12 and the lens 16 are also visible in FIG. 2. The socket assembly 14 includes a socket 28, a light emitting diode (LED) package 30 held by the socket 28, an optional lens 32, and an optional thermal transfer pad 34. The socket 28 includes a socket housing 36 and mounting clips 38 that releasably holds the socket housing 36 on the base 12. In the exemplary embodiment, the LED package 30 includes a printed circuit board (PCB) 35 and one of the LEDs 18 mounted on the PCB 35. Alternatively, the LED 18 is not mounted on the PCB 35 such that the LED package 30 does not include the PCB 35. Although only a single LED 18 is shown mounted on the PCB 35, any number of LEDs 18 may be mounted on the PCB 35. The PCB 35 may be sized appropriately depending on the number of LEDs 18 mounted thereon.

Figure 3:
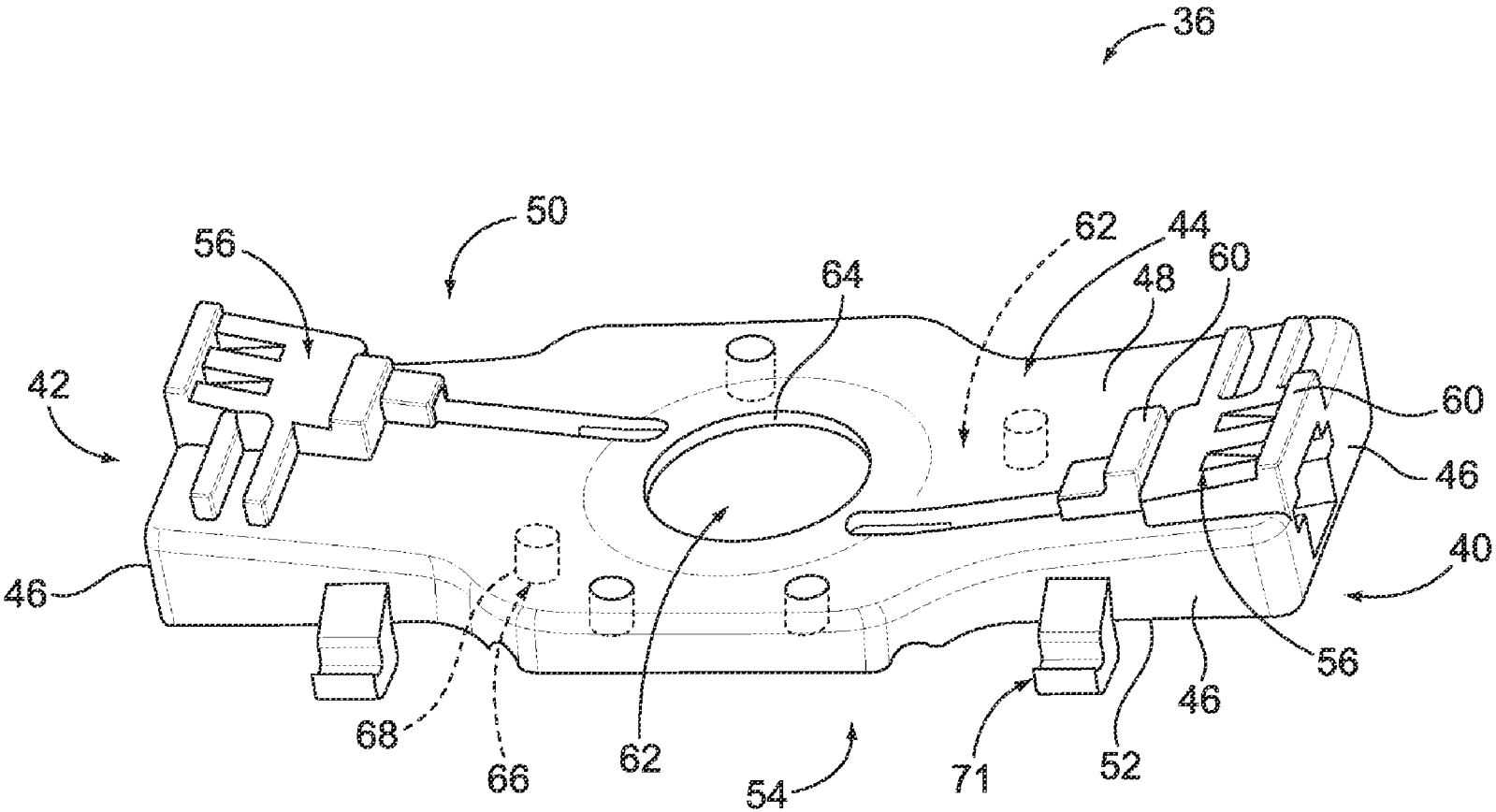
FIG. 3 is a perspective view of an exemplary embodiment of a socket housing of the socket assembly shown in FIG. 2.

FIG. 3 is a perspective view of an exemplary embodiment of the socket housing 36. The socket housing 36 extends a length from an end 40 to an opposite end 42, and includes a top wall 44 and side walls 46 that extend from corresponding edges of the top wall 44. An exterior surface 48 of the top wall 44 defines a clip side 50 of the socket housing 36. The side walls 46 extend outwardly from the top wall 44 to end surfaces 52 that define a base side 54 of the socket housing 36. Each side wall 46 thereby extends from the clip side 50 of the socket housing 36 to the base side 54. The base side 54 of the socket housing 36 is configured to be mounted on the base 12 (FIGS. 1, 2, 5, and 6) in engagement therewith. Optionally, the socket housing 36 includes alignment channels 56 that receive straps 72 (FIGS. 2 and 4) of the mounting clips 38 (FIGS. 2, 4, 5, and 6) therein, as will be described below. Each alignment channel 56 is defined between a corresponding pair of opposing alignment members 60 that each extend outwardly on the top wall 44 (and thus along the clip side 50) of the socket housing 36.

The socket housing 36 includes a receptacle 62 that receives the LED package 30 (FIGS. 2 and 5) therein. Specifically, the receptacle 62 extends into the socket housing 36 through the base side 54 such that the base side 54 is open and configured to receive the LED package 30 therethrough. The receptacle 62 is bounded by an interior surface of the top wall 44 and interior surfaces of the side walls 46. An opening 64 extends through the clip side 50 of the socket housing 36 into the receptacle 62. Specifically, the opening 64 extends completely through the top wall 44 such that the opening 64 is in fluid communication with the receptacle 62. As will be described below, the opening 64 exposes the LED 18 (FIGS. 2 and 5) such that the LED 18 emits light through the opening 64. In an alternative embodiment, the receptacle 62 extends into the socket housing 36 through the clip side 50, or more specifically through the top wall 44, and is bounded by a bottom wall (not shown) of the socket housing 36.

Figure 5:
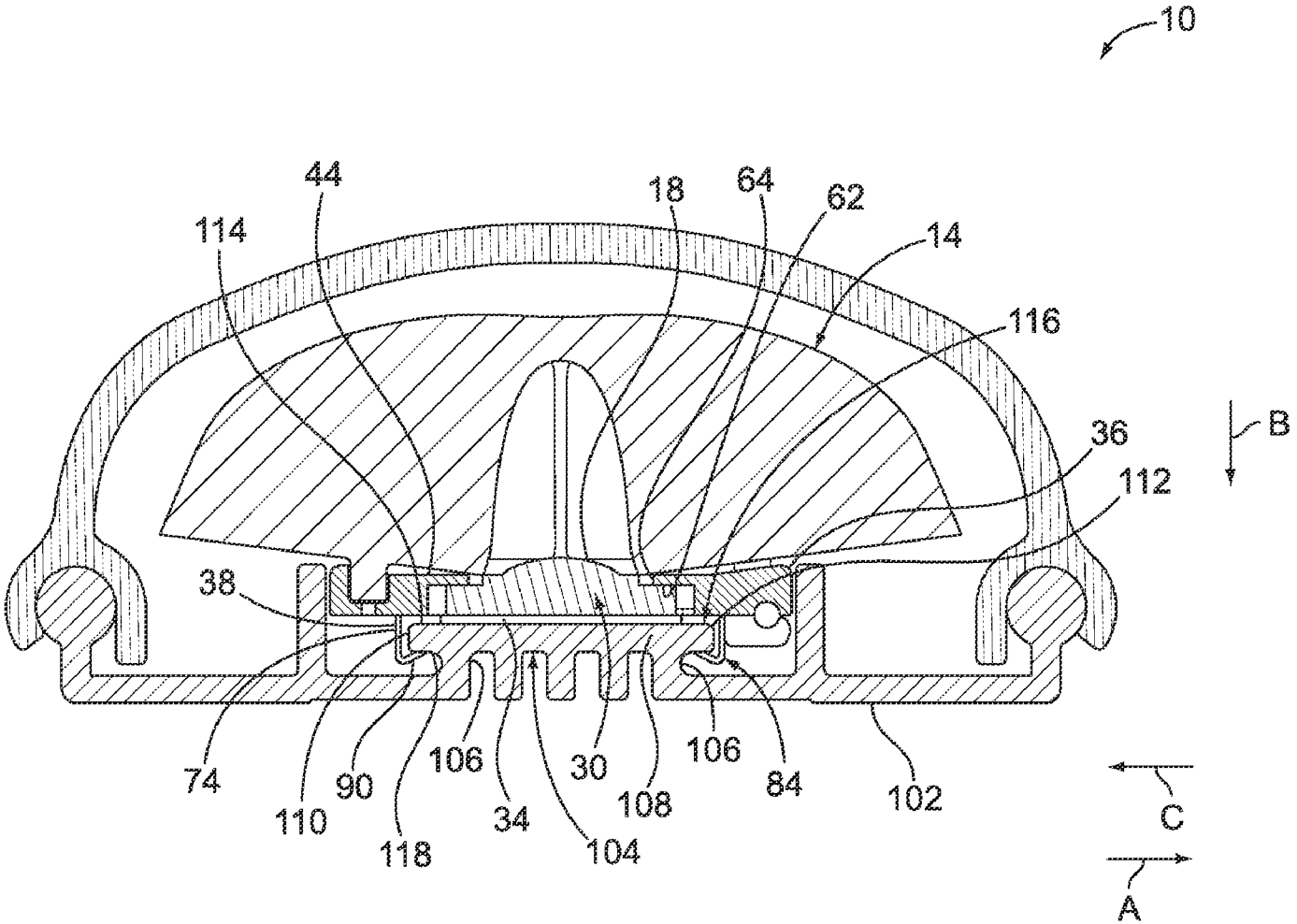
FIG. 5 is a cross-sectional view of the lighting fixture shown in FIG. 1 taken along line 5-5 of FIG. 1.

Optionally, the socket housing 36 includes one or more securing features 66 that engage the LED package 30 to hold the LED package 30 in position within the receptacle 62. In the exemplary embodiment, the securing features 66 include pegs 68 that extend into the receptacle 62 and are configured to be received within corresponding openings 70 (FIG. 2) within the PCB 35 (FIGS. 2 and 5). The pegs 68 are optionally received within the openings 70 with an interference fit. Although two pegs 68 are shown, the socket housing 36 may include any number of the pegs 68. Moreover, any other suitable type of securing features 66 besides the pegs 68 and openings 70 may be provided.

The socket housing 36 includes optional wire managers 71 that are configured to hold portions of the main power cable 26 (FIG. 1), a cable (not shown) that extends from an adjacent socket assembly 14, and/or a cable (not shown) that branches off from the main power cable 26. In the exemplary embodiment, the socket housing 36 includes four side walls 46 that combine with the top wall 44 to provide the socket housing 36 with the general overall shape of a parallelepiped. But, the socket housing 36 may include any number of the side walls 46 and may include any other overall shape. Each of the side walls 46 may be referred to herein as a "first side wall" and/or a "second side wall".

Figure 4:
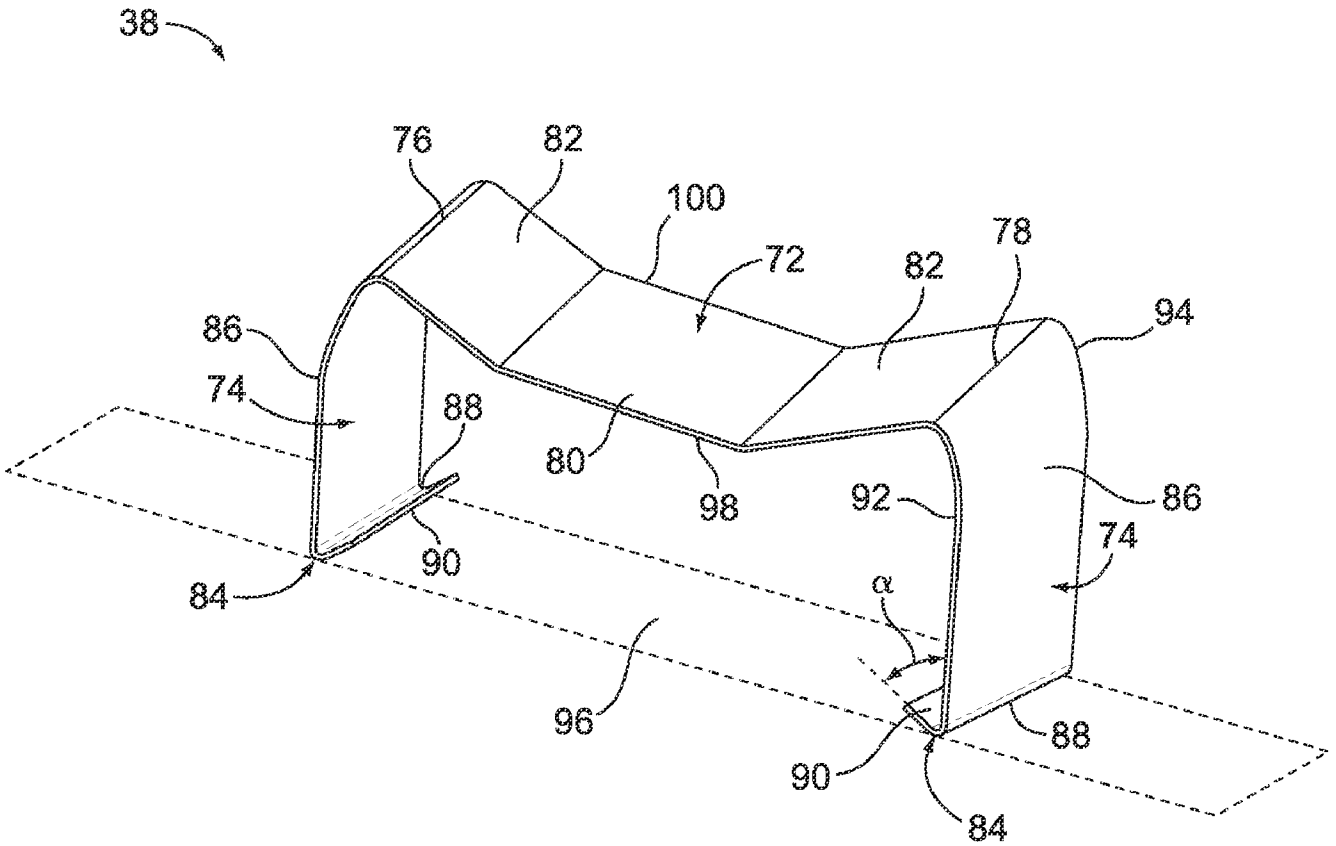
FIG. 4 is a perspective view of an exemplary embodiment of a mounting clip of the socket assembly shown in FIG. 2.

FIG. 4 is a perspective view of an exemplary embodiment of one of the mounting clips 38. The mounting clip 38 includes a strap 72 and arms 74 that extend from the strap 72. The strap 72 extends a length from an end 76 to an opposite end 78. One of the arms 74 extends outwardly from the end 76 of the strap 72, while the other arm 74 extends outwardly from the opposite end 78 of the strap 72. In the exemplary embodiment, the strap 72 includes a middle segment 80 and two outer segments 82 that extend from opposite ends of the middle segment 80. As can be seen in FIG. 4, the outer segments 82 are angled with respect to the middle segment 80. Alternatively, one or both of the outer segments 82 are not angled relative to the middle segment 80, but rather extend approximately co-planar with respect to the middle segment 80. Each of the outer segments 82 may extend from the middle segment 80 at any angle with respect to the middle segment 80. The angle of the outer segments 82 relative to the middle segment 80 of the strap 72 may be selected to provide the arms 74 with a predetermined amount of resilient deflection. The arms 74 may each be referred to herein as a "first arm" and/or a "second arm".

Each arm 74 of the mounting clip 38 extends outwardly from the strap 72 to a hook 84. Each arm 74 includes a main segment 86 that extends from a length from the strap 72 to an end 88. A tab 90 extends outwardly from the end 88 of the main segment 86 of the arm 74. The hook 84 is defined by the tab 90 and a portion of the main segment 86 of the arm 74 that includes the end 88. In the exemplary embodiment, the hook 84 is positioned on the arm 74 at the end 88 of the main segment 86. Alternatively, the hook 84 of one or both of the arms 74 is positioned at a different location along the length of the main segment 86, for example a location that is remote from the end 88 of the main segment 86. The tab 90 extends at an angle α relative to the portion of the main segment 86 that includes the end 88. In the exemplary embodiment, the angle α of the tab 90 is acute. However, the angle α of the tab 90 may alternatively be perpendicular or obtuse relative to the portion of the main segment 86 that includes the end 88.

The arms 74 of the mounting clip 38 are configured to engage the base 12 (FIGS. 1, 2, 5, and 6) of the lighting fixture 10 (FIGS. 1, 2, 5, and 6) to hold the socket housing on the base 12. Specifically, the hooks 84 of the arms 74 are configured to engage a flange 116 (FIGS. 2, 5, and 6) of the base 12. The arms 74 are resiliently deflectable into and out of engagement with the base 12 such that the arms 74 are configured to engage the base 12 in a snap-fit connection. To deflect the arms 74, the mounting clip 38 may bend at the interface between the ends 76 and 78 of the strap 72 and the main segments 86. In addition or alternative, the mounting clip 38 may bend at the interfaces between the middle segment 80 and outer segments 82 of the strap 72, and/or the main segments 86 of the arms 74 may bend along the length thereof to deflect the arms 74.

The arms 74 of the mounting clip 38 include opposite front and rear edges 92 and 94, respectively. Optionally, one of the edges 92 or 94 of the main segment 86 of each arm 74 has a greater length than the other edge 92 or 94, which orients the strap 72 of the mounting clip 38 with an angle relative to the ends 88 of the main segments 86 of the arms 74. For example, the ends 88 are shown in FIG. 4 aligned within a common plane 96. Rather than extending parallel to the plane 96, the strap 72 is angled relative to the plane 96, as should be apparent in FIG. 4. In the exemplary embodiment, the rear edge 94 of the main segment 86 of each arm 74 has a greater length than the front edge 92. Accordingly, the strap 72 slopes upwardly away from the plane 96 as the strap 72 extends from a front edge 98 thereof to a rear edge 100 thereof. The direction and amount of the slope of the strap 72 relative to the ends 88 may be selected to provide the mounting clip 38 with a shape that is complementary with a contour of the socket housing 36 (FIGS. 2 and 5).

FIG. 5 is a cross-sectional view of the lighting fixture taken along line 5-5 of FIG. 1. The base 12 includes a bottom wall 102 and a platform 104 that extends upwardly from the bottom wall 102. The platform 104 includes side walls 106 that extend outwardly from the bottom wall 102 to a platform wall 108. The platform wall 108 extends a width from an end 110 to an opposite end 112, and includes a mounting surface 114 on which the socket housing 36 is configured to be mounted. The side walls 106 are offset from the corresponding ends 110 and 112 toward a center of the width of the platform wall 108. The offset of the side walls 106 provides flanges 116 that are configured to be engaged by the hooks 84 of the mounting clip 38, as will be described below. Hook surfaces 118 of the flanges 116 that are opposite the mounting surface 114 are configured to be engaged by the hooks 84. As can be seen in FIG. 5, in the exemplary embodiment, the platform 104 includes a cross-sectional profile having a T-shape. The profile of the platform is complementary with the shape of the mounting clip 38. The platform 104 may additionally or alternatively include other cross-sectional profile shapes.

Referring again to FIG. 2, to mount the socket assembly 14 on the base 12, the LED package 30 is positioned on the platform 104 of the base 12. Optionally, the thermal transfer pad 34 is engaged between the PCB 35 and the mounting surface 114 of the platform 104. The thermal transfer pad 34 is configured to dissipate heat generated by the LED 18 through the base 12. The socket housing 36 is positioned over the LED package 30 and loaded onto the platform 104 such that the LED package 30 is received within the receptacle 62 of the socket housing 36. The base side 54 of the socket housing 36 is engaged with the mounting surface 114 of the platform 104. Alternatively, the LED package 30 can be loaded into the receptacle 62 of the socket housing 36 before the socket housing 36 is loaded onto the platform 104.

In the exemplary embodiment, each of the mounting clips 38 extends over the socket housing 36 proximate a corresponding one of the ends 40 and 42 of the socket housing 36. The straps 72 of the mounting clips 38 extend within the corresponding alignment channels 56 on the socket housing 36 to locate and orient the straps 72 along the clip side 50 of the socket housing 36. As should be apparent from FIG. 2, the slope of the straps 72 match the contour of the socket housing 36 at the alignment channels 56.

The strap 72 of each mounting clip 38 extends over and is engaged with the top wall 44 (and thus the clip side 50) of the socket housing 36. Each of the arms 74 of the mounting clips 38 extends outwardly from the corresponding strap 72 along a corresponding one of the side walls 46 of the socket housing 36. As can be seen in FIG. 2, the arms 74 extend outwardly from the corresponding strap 72 and along the corresponding side wall 46 past the base side 54, or more specifically past the end surfaces 52.

Figure 6:
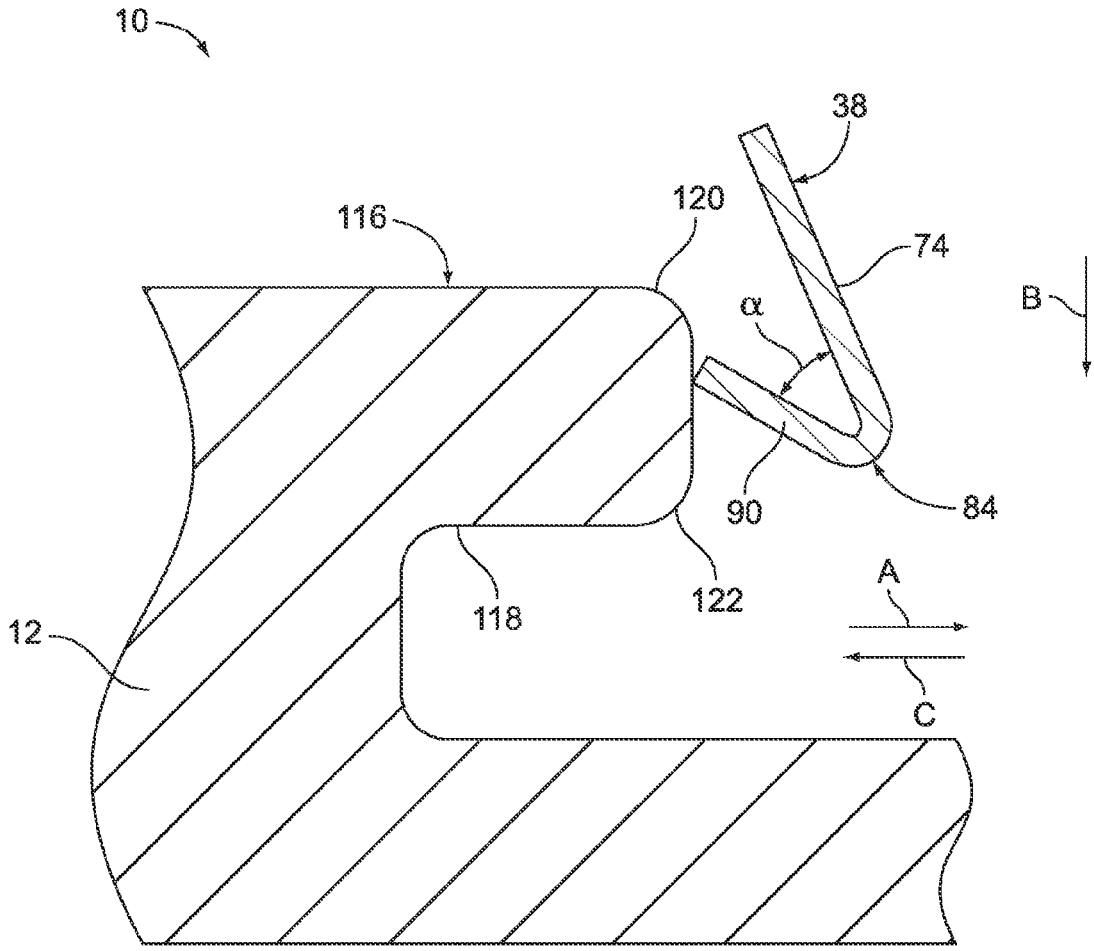
FIG. 6 is an enlarged cross-sectional view of a portion of the lighting fixture shown in FIG. 1.

FIG. 6 is an enlarged cross-sectional view of a portion of the lighting fixture 10 illustrating deflection of the hook 84 of one of the mounting clips 38 as the hook 84 is engaged with the base 12. As the mounting clip 38 is loaded onto the base 12 (whether with the socket housing 36 or after the socket housing 36 has been loaded onto the base 12), the tab 90 of the hook 84 engages a shoulder 120 of the corresponding flange 116. Engagement with the shoulder 120 deflects the arm 74 of the mounting clip 38 generally in the direction of the arrow A from the position shown in FIGS. 2, 4, and 5 to the position shown in FIG. 6. The angle α of the tab 90 may be selected to facilitate the deflection of the arm 74 caused by the engagement with the shoulder 120.

As the hook 84 of the mounting clip 38 travels further past the mounting surface 114 in the direction of the arrow B, the tab 90 eventually clears a shoulder 122 of the flange 116. The resilience of the arm 74 then causes the hook 84 to snap in the direction of the arrow C back to the position shown in FIGS. 2, 4, and 5. Specifically, referring again to FIG. 5, the hooks 84 of the mounting clips 38 are engaged with corresponding flanges 116. The resilience of the arms 74 of the mounting clip 38 has caused the hooks 84 to snap back (in the direction of the arrow C) to the position shown in FIG. 5, wherein the tabs 90 of the hooks 84 are engaged with the hook surfaces 118 of the flanges 116. The engagement between the hooks 84 and the hook surfaces 118 connects the mounting clip 38 to the base 12, and thus the socket assembly 14 to the base 12. The snap action of the hooks 84 described and illustrated above provides a snap-fit connection between the mounting clip 38 and the base 12, and thereby between the socket assembly 14 and the base 12. To release the socket assembly 14 from the base 12, the arms 74 of the mounting clips 38 can be deflected in the direction of the arrow A such that the hooks 84 clear the shoulders 122 (FIG. 6), thereby allowing the mounting clips 38 to be removed from the base 12.

When mounted to the base 12 as shown herein and described above, the mounting clips 38 hold the socket assembly 14 on the platform 104 of the base 12 between the platform 104 and the straps 72 (FIGS. 2 and 4). The LED package 30 is held within the receptacle 62 of the socket housing 36 such that the LED package 30 is sandwiched between the top wall 44 of the socket housing 36 and the mounting surface 114 of the platform 104 of the base 12. The LED 18 is exposed to emit light through the opening 64 within the socket housing 36. Optionally, the mounting clips 38 apply a force against the socket housing 36 in a direction generally toward the base 12 (i.e., the direction of the arrow B) to facilitate good engagement between the thermal transfer pad 34, the LED package 30, and the mounting surface 114 of the base 12.

Referring again to FIG. 2, in addition or alternative to the mounting clips 38, the socket assembly 14 may be held on the base 12 using other mechanical hardware and/or an adhesive, such as, but not limited to, using screws, rivets, glue, double-sided tape, epoxy, solder, and/or the like. Although two mounting clips 38 are shown, any number of mounting clips 38 may be used to hold the socket assembly 14 on the base 12. Each mounting clip 38 may extend over any location on the socket housing 36. For example, in the exemplary embodiment, the arms 74 of the mounting clips 38 extend over side walls 46*a* and 46*b* that extend along the length of the socket housing 36. The straps 72 of the exemplary embodiment of the mounting clips 38 are therefore oriented approximately perpendicular to the length of the socket housing 36. Alternatively, the length of the strap 72 of one or more of the mounting clips 38 extends approximately parallel to the length of the socket housing 36, with the arms 74 extending over side walls 46*c* and 46*d* of the socket housing 36. Embodiments are also envisioned wherein the length of the strap 72 of one or more of the mounting clips 38 extends at an oblique angle relative to the length of the socket housing 36, whether the arms 74 extend over the side walls 46*a* and 46*b* or extend over the side walls 46*c* and 46*d*. In another alternative embodiment, only a single mounting clip 38 is provided, for example extending along a center of the length of the socket housing 36 or proximate one of the ends 40 or 42 of the socket housing 36.

Figure 7:
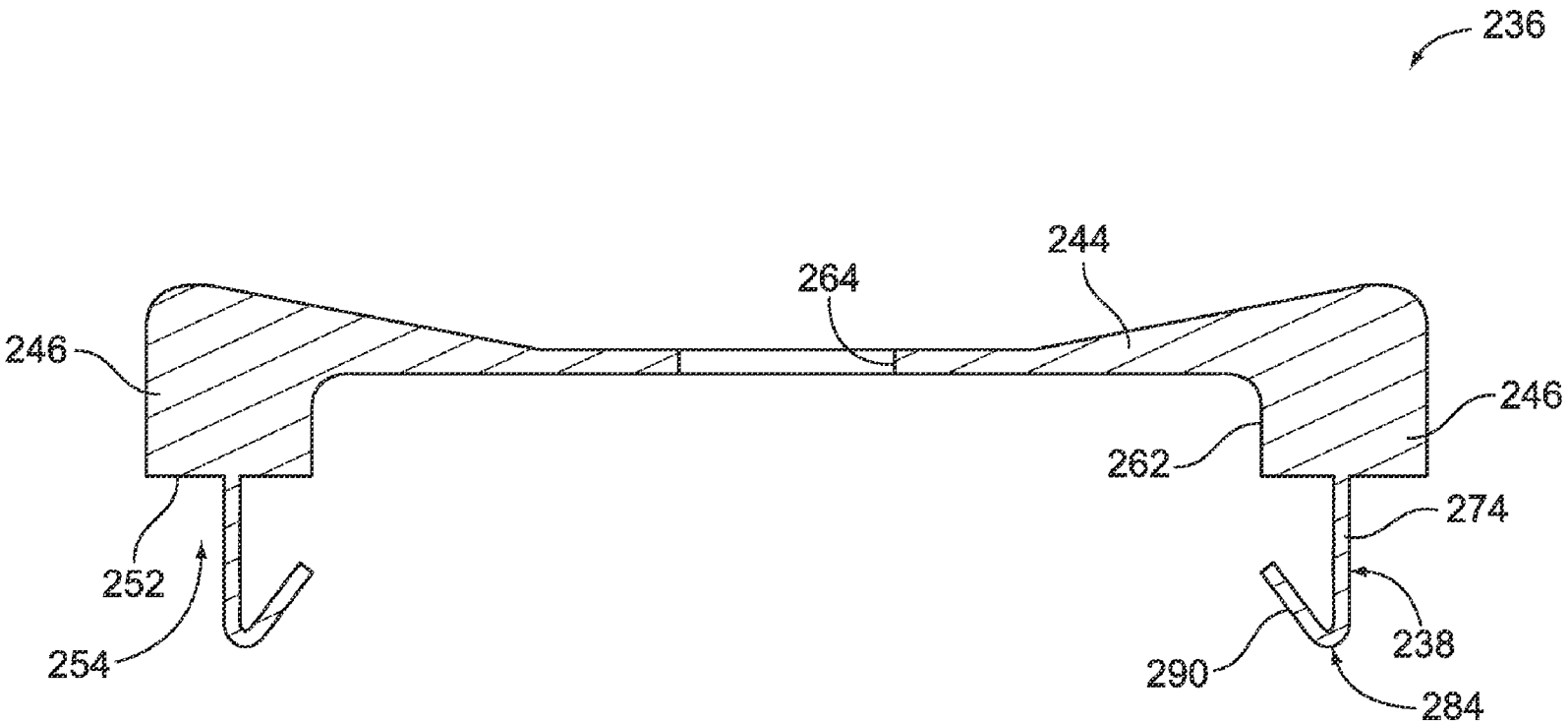
FIG. 7 is a cross-sectional view of an exemplary alternative embodiment of a socket housing of the socket assembly shown in FIG. 2.

FIG. 7 is a cross-sectional view of an exemplary alternative embodiment of a socket housing 236 of the socket assembly 14 (FIGS. 1, 2, 5, and 8). The socket housing 236 is similar to the socket housing 36 (FIGS. 2 and 5). However, while the mounting clips 38 (FIGS. 2, 4, 5, and 6) of the socket assembly 14 are discrete components from the socket housing 36, the socket housing 236 includes mounting features 238 that are formed integrally with the socket housing 236.

The socket housing 236 includes a top wall 244 and side walls 246 that extend from corresponding edges of the top wall 244. The side walls 246 extend outwardly from the top wall 244 to end surfaces 252 that define a base side 254 of the socket housing 236. The base side 254 of the socket housing 236 is configured to be mounted on the base 12 (FIGS. 1, 2, 5, and 6) in engagement therewith. The socket housing 236 includes a receptacle 262 that receives the LED package 30 (FIGS. 2 and 5) therein. The receptacle 262 extends into the socket housing 236 through the base side 254. An opening 264 extends through the top wall 244 of the socket housing 236 into the receptacle 262 for exposing the LED 18 (FIGS. 2 and 5).

The mounting features 238 of the socket housing 236 include arms 274 that extend outwardly from the end surfaces 252 of the side walls 246 along the base side 254. The arms 274 are formed integrally with the remainder of the socket housing 236, for example using a molding process, a machining process, a casting process, and/or the like. In the exemplary embodiment, the arms 274 are formed from the same materials as the remainder of the socket housing 236. Alternatively, the arms 274 are formed from one or more different materials than the remainder of the socket housing 236 and are incorporated into the remainder of the socket housing 236 before or during the process of forming the socket housing 36. For example, in one alternative embodiment, the arms 274 are formed from a metallic material and are inserted into the remainder of the socket housing 36 before or during a molding process used to form the remainder of the socket housing 236. Yet another alternative embodiment includes arms 274 that are not formed integrally with the socket housing 236, but rather are mechanically connected to the socket housing 236 after the socket housing 236 has been formed.

Each arm 274 extends outwardly from the corresponding end surface 252 to a hook 284. The hooks 284 include tabs 290 that engage the hook surfaces 118 (FIGS. 5 and 6) of the base 12. Similar to the arms 74 (FIGS. 2, 4, 5, and 6) of the mounting clips 38, the arms 274 are configured to engage the flanges 116 (FIGS. 2, 5, and 6) of the base 12 in a snap-fit connection. Specifically, the hooks 284 of the arms 274 are resiliently deflectable into and out of engagement with the hook surfaces 118 of the base 12 in a substantially similar manner to that described above with respect to the mounting clips 38.

Referring again to FIG. 2, the socket assembly 14 includes the optional lens 32. The lens 32 is configured to condition light emitted from the LED 18 in a predetermined manner (e.g., color, refraction, and/or the like). The lens 32 is mounted on the socket housing 36 using one or more mounting members 124. In the exemplary embodiment, the mounting members 124 include holes 126 that extend within the top wall 44 of the socket housing 36. The holes 126 receive pegs (not shown) that extend outwardly along a bottom side 129 of the lens 32. The pegs are optionally received within the holes 126 with an interference fit. Although three holes 126 are shown, the socket housing 36 may include any number of the holes 126. Moreover, any other suitable type of mounting members 124 besides the holes 126 and pegs may be provided.

The optional lens 16 is also provided in the exemplary embodiment. Similar to the lens 32, in the exemplary embodiment the lens 16 is configured to condition light emitted from the LED 18 in a predetermined manner (e.g., color, refraction, and/or the like). The lens 16 may additionally or alternatively provide a protective barrier that extends over the socket assemblies 14 to protect the socket assemblies 14 from moisture, dirt, debris, and/or other contaminants. The base 12 of the lighting fixture 10 includes rails 128 for holding the lens 16 on the base 12. Specifically, the lens 16 includes connection members 130 that connect to the rails 128. Each connection member 130 includes opposing arms 131 that grip the rail 128 to hold the lens 16 on the base 12. Optionally, the arms 131 are resiliently deflectable such that the connection members 130 connect to the rails using a snap-fit connection. In addition or alternatively, the connection members 130 are slid over the rails 128 from an of the base 12.

The LED package 30 includes a plurality of power contacts 132 on the PCB 35 for receiving electrical power to drive the LED 18. In the exemplary embodiment, the power contacts 132 are positioned proximate a corresponding one of the edges of the PCB 35. Any number of power contacts 132 may be provided. The socket assembly 14 includes power connectors 134 coupled to the power contacts 132. The power connectors 134 are configured to supply power to the power contacts 132 from the power source (not shown).

Figure 8:
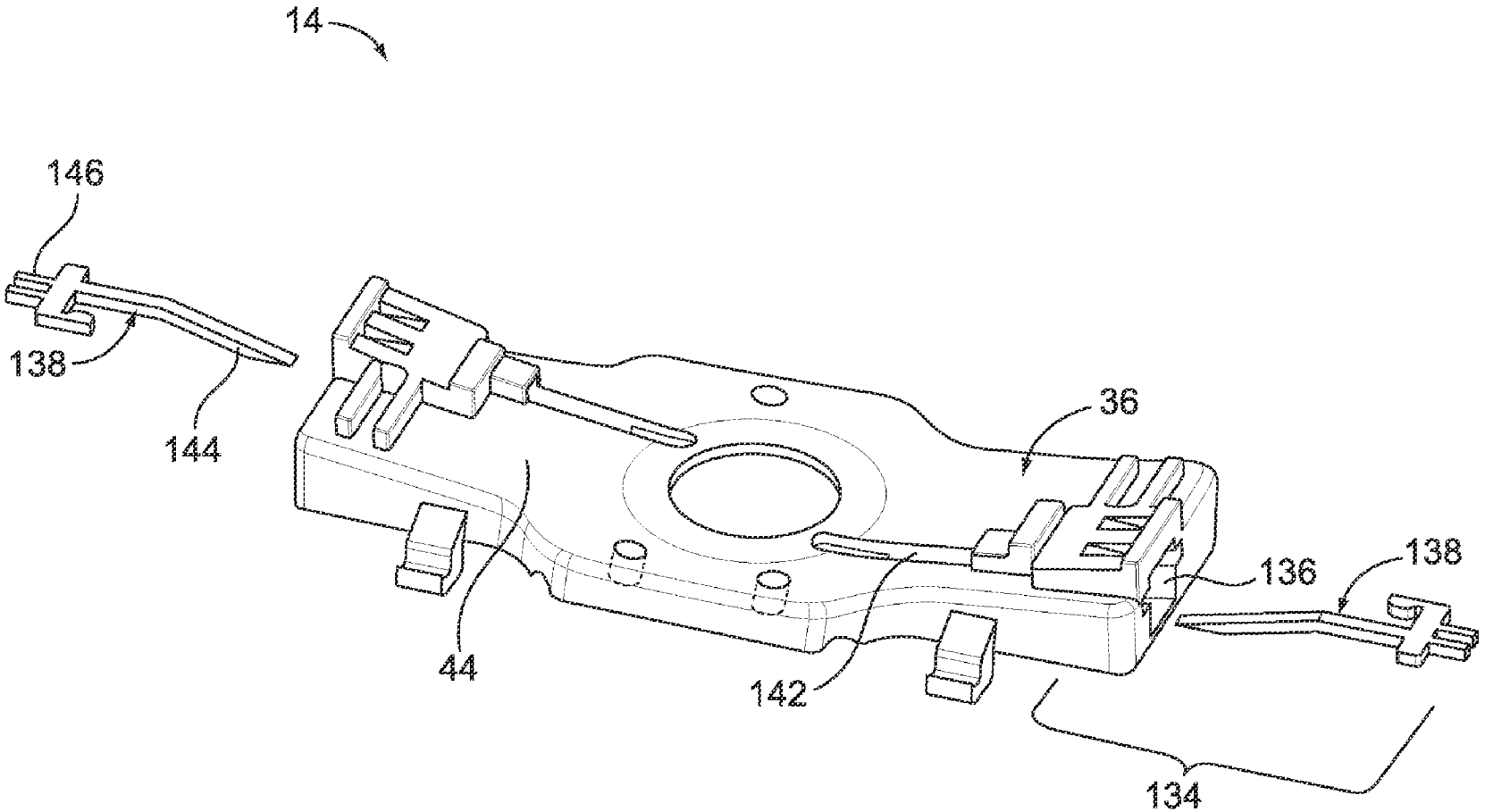
FIG. 8 is an exploded perspective view of a portion of the socket assembly shown in FIG. 2 illustrating an exemplary embodiment of power connectors of the socket assembly.

FIG. 8 is an exploded perspective view of a portion of the socket assembly 14 illustrating an exemplary embodiment of the power connectors 134. Each power connector 134 includes a port 136 formed in the socket housing 36 and one or more individual mating contacts 138 positioned within the port 136. The port 136 is configured to receive a plug 140 (FIG. 2) that terminates the main power cable 26 (FIG. 1), that terminates a cable (not shown) that extends from an adjacent socket assembly 14, or that terminates a cable (not shown) that branches off from the main power cable 26. The socket housing 36 includes contact channels 142 that extend within the top wall 44 from the port 136 into the receptacle 62. The mating contacts 138 include mating tips 144 that extend through the contact channels 142 into engagement with the power contacts 132 (FIG. 2) on the PCB 35 (FIG. 2). Alternatively, the mating tips 144 engage power contacts (not shown) on the LED 18 (FIGS. 2 and 5). The mating contacts 138 also include pins 146 that mate with the plug 140 when the plug 140 is received in the port 136.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A socket assembly for mounting on a base of a lighting fixture, said socket assembly comprising:

a socket housing having a base side, a clip side, and a side wall extending from the base side to the clip side, the base side of the socket housing being configured to be mounted on the base of the lighting fixture, the socket housing comprising a receptacle extending therein;

a light emitting diode (LED) held within the receptacle of the socket housing; and a mounting clip comprising a strap and an arm that extends from the strap, the strap extending over and being engaged with the clip side of the socket housing, the arm extending outwardly from the strap along the side wall of the socket housing and being configured to engage the base of the lighting fixture to hold the socket housing on the base.

2. The socket assembly according to claim 1, wherein the arm of the mounting clip extends outwardly from the strap to a hook, the hook being configured to engage a flange on the base of the lighting fixture to hold the socket housing on the base.

3. The socket assembly according to claim 1, wherein the arm of the mounting clip is resiliently deflectable into and out of engagement with the base of the lighting fixture.

4. The socket assembly according to claim 1, wherein the socket housing comprises opposing alignment members extending outwardly on the clip side, a channel being defined on the clip side of the socket housing between the alignment members, the strap of the mounting clip being received within the channel.

5. The socket assembly according to claim 1, wherein the arm is a first arm and the side wall of the socket housing is a first sidewall, the socket housing comprising a second side wall that extends from the base side to the clip side, the first arm extending outwardly from an end of the strap of the mounting clip, the mounting clip further comprising a second arm extending outwardly from an opposite end of the strap, the second arm extending outwardly from the strap along the second side wall of the socket housing and being configured to engage the base of the lighting fixture to hold the socket housing on the base.

6. The socket assembly according to claim 1, wherein the arm of the mounting clip extends outwardly from the strap along the side wall past the base side of the socket housing.

7. The socket assembly according to claim 1, wherein the receptacle extends into the socket housing through the base side, the socket housing further comprising an opening extending through the clip side in fluid communication with the receptacle for exposing the LED.

8. The socket assembly according to claim 1, wherein the socket housing comprises opposite ends, the mounting clip extending over the socket housing proximate one of the ends, the socket assembly further comprising another mounting clip extending over the socket housing proximate the other end and being configured to engage the base of the lighting fixture.

9. The socket assembly according to claim 1, further comprising an LED package comprising the LED and a printed circuit board (PCB), the LED being mounted on the PCB, the LED package being held within the receptacle.

10. A lighting fixture comprising:

a base; and a socket assembly mounted on the base, the socket assembly comprising:

a socket housing having a base side, a clip side, and a side wall extending from the base side to the clip side, the base side of the socket housing being mounted on the base, the socket housing comprising a receptacle extending therein;

a light emitting diode (LED) held within the receptacle of the socket housing; and a mounting clip comprising a strap and an arm that extends from the strap, the strap extending over and being engaged with the clip side of the socket housing, the arm extending outwardly from the strap along the side wall of the socket housing and being engaged with the base to hold the socket housing on the base between the base and the strap.

11. The lighting fixture according to claim 10, wherein the base comprises a flange, the arm of the mounting clip extending outwardly from the strap to a hook that is engaged with the flange of the base.

12. The lighting fixture according to claim 10, wherein the base comprises a platform having a mounting surface and an opposite hook surface, the base side of the socket housing being engaged with the mounting surface of the base, the arm of the mounting clip extending outwardly from the strap past the mounting surface of the base to a hook that is engaged with the hook surface of the platform.

13. The lighting fixture according to claim 10, wherein the base comprises a profile that is complementary with a profile of the mounting clip.

14. The lighting fixture according to claim 10, wherein the base comprises a heat sink.

15. The lighting fixture according to claim 10, wherein the mounting clip applies a force against the socket housing in a direction generally toward the base.

16. The lighting fixture according to claim 10, wherein the receptacle extends into the socket housing through the base side, the socket housing further comprising an opening extending through the clip side in fluid communication with the receptacle for exposing the LED.

17. A socket assembly for mounting on a base of a lighting fixture, said socket assembly comprising:

a socket comprising a housing and a mounting feature, the housing having a base side that is configured to be mounted on the base of the lighting fixture, a receptacle extending into the housing, the mounting feature comprising a resiliently deflectable arm that is configured to engage the base of the lighting fixture in a snap-fit connection to releasably mount the socket to the base; and a light emitting diode (LED) held within the receptacle of the housing of the socket;

wherein the housing of the socket comprises a clip side and a side wall extending from the clip side to the base side, the mounting feature comprising a mounting clip that is discrete from the housing of the socket, the mounting clip comprising a strap and the deflectable arm, the strap extending over and engaged with the clip side of the housing, the deflectable arm extending outwardly from the strap along the side wall.

18. The socket assembly according to claim 17, wherein the deflectable arm of the mounting feature is integrally formed with the housing of the socket.

19. The socket assembly according to claim 17, wherein the deflectable arm of the mounting feature comprises a hook that is configured to engage a flange on the base of the lighting fixture.

* * * * *